US005560062A

United States Patent [19]

Mercalli et al.

[11] Patent Number: 5,560,062

[45] Date of Patent: Oct. 1, 1996

[54] METHOD AND DEVICE FOR MACHINING THE BOTTOM OF FOOTWEAR

[75] Inventors: Luciano Mercalli, Vigevano; Paolo Marazzi, Torlino Vimercati, both of Italy

[73] Assignee: Officine Meccaniche Cerim SpA., Vigevano, Italy

[21] Appl. No.: 398,964

[22] Filed: Mar. 2, 1995

[30] Foreign Application Priority Data

Mar. 17, 1994 [IT] Italy ..... MI94A0492

[51] Int. Cl.[6] ..... A43D 95/00; A43D 8/34

[52] U.S. Cl. ..... 12/77; 12/8.3; 12/57.5; 12/58; 12/77.5

[58] Field of Search ..... 12/12, 8.3, 34, 12/51, 57.5, 57.6, 58, 70, 77, 77.5, 52.5

[56] References Cited

U.S. PATENT DOCUMENTS

| | | | |
|---|---|---|---|
| 2,181,238 | 11/1939 | Kamborian | 12/57.6 |
| 3,113,446 | 12/1963 | Schwabe | 12/51 |
| 3,591,878 | 7/1971 | Muhlbach | 12/8.3 |
| 4,006,504 | 2/1977 | Gadd | 12/8.3 |
| 4,134,278 | 1/1979 | Becka | 12/77 X |
| 4,649,585 | 3/1987 | Petrzelka et al. | 12/77 X |
| 4,756,038 | 7/1988 | Stein | 12/77 X |

*Primary Examiner*—Marie D. Patterson
*Attorney, Agent, or Firm*—Robert W. J. Usher

[57] ABSTRACT

A method for removing material from a portion of an edge of a shoe upper folded over the bottom of a shoe, comprises the steps of moving the bottom of the shoe in relation to lateral roughing wheels (15) for roughing the edges according to two different paths and in relation to a first (26) and a second tool (22) for roughing the heel and toe areas. The roughing wheels (15) rotate according to an axis substantially parallel to the length of the footwear to provide a removing action directed towards the inside of the bottom, and are movable along a path comprising a forward stroke and a return stroke which are carried out at different distances towards the inside of the bottom. The first tool and the second tool rotate to provide a removing action directed towards the inside of the bottom along a path substantially parallel to the length of the footwear in respective heel and toe areas.

25 Claims, 2 Drawing Sheets

METHOD AND DEVICE FOR MACHINING THE BOTTOM OF FOOTWEAR

BACKGROUND OF THE INVENTION

This invention refers to a device for automatically rough scouring and roughing the edge of an upper folded over the bottom of footwear.

It is a well-known fact that in the art of shoe-making it is necessary to remove the pleats on the edge of the upper folded over the bottom, so as to be able to carry out the subsequent roughing operation. Removal of the pleats, known as rough scouring, is usually carried out by hand by an operator who passes the edge to be removed over a sandpapering machine and then fits the footwear onto the next machine, which is usually a roughing or pounding machine. In addition to the time required it is also necessary for the operator to possess good manual skills, since the thickness and roughness of the area to be removed vary considerably along the perimeter of the footwear. In particular, the areas which require more rough scouring are the heel and toe, while on the intermediate areas it may not be necessary or they may simply require a light scouring before roughing.

The general scope of this invention is to obviate the aforementioned problems, by providing a method and a device for automatically carrying out the rough scouring and roughing on the bottoms of footwear, carrying out both the rough-machining and finishing of the edge of the upper, to obtain a surface having perfect characteristics for the subsequent operations, such as sticking on the sole.

SUMMARY OF THE INVENTION

This scope is achieved by providing a method for removing material from a portion of the edge of an upper folded over the bottom of a shoe, comprising, according to the invention, the steps of moving the bottom of the footwear in relation to lateral roughing wheels rotating according to an axis substantially parallel to the length of the footwear to provide a removing action directed towards the inside of the bottom along a path comprising a forward stroke and a return stroke along the lateral edge of the bottom of the footwear, the forward stroke and return stroke being carried out at different distances towards the inside of the bottom; moving the bottom of the footwear in relation to a first tool rotating according to an axis substantially perpendicular to the length of the footwear and substantially parallel to its bottom to provide a removing action directed towards the inside of the bottom along a path substantially parallel to the length of the footwear in a heel area of the bottom; moving the bottom of the footwear in relation to a second tool rotating according to an axis substantially perpendicular to the length of the footwear and substantially parallel to its bottom to provide a removing action directed towards the inside of the bottom along a path substantially parallel to the length of the footwear in a toe area of the bottom.

The scope is further achieved, according to the invention, by providing a device for removing material from a portion of the edge of the upper folded over the bottom of the footwear, comprising a support for the footwear at the side of which are disposed roughing wheels with an axis of rotation substantially parallel to the length of the footwear, posteriorly and anteriorly to the support being disposed, respectively, further rear and front working tools rotating according to an axis substantially perpendicular to the length of the footwear and substantially parallel to its bottom, the footwear support being movable in the direction of the length of the footwear in relation to roughing wheels and front and rear tools to shift the footwear bottom to the working area of the roughing wheels along the lateral edge of the bottom of the footwear and to shift the bottom of the footwear to working areas of the front tool and the rear tool on respective toe and heel areas of the bottom with an action towards the inside of the bottom.

BRIEF DESCRIPTION OF THE INVENTION

The innovative principles of this invention and its advantages with respect to the known technique will be more clearly evident from the following description of a possible exemplificative and non-restrictive embodiment applying such principles, with reference to the accompanying drawings, in which.

DETAILED DESCRIPTION OF THE INVENTION

Figure 1:
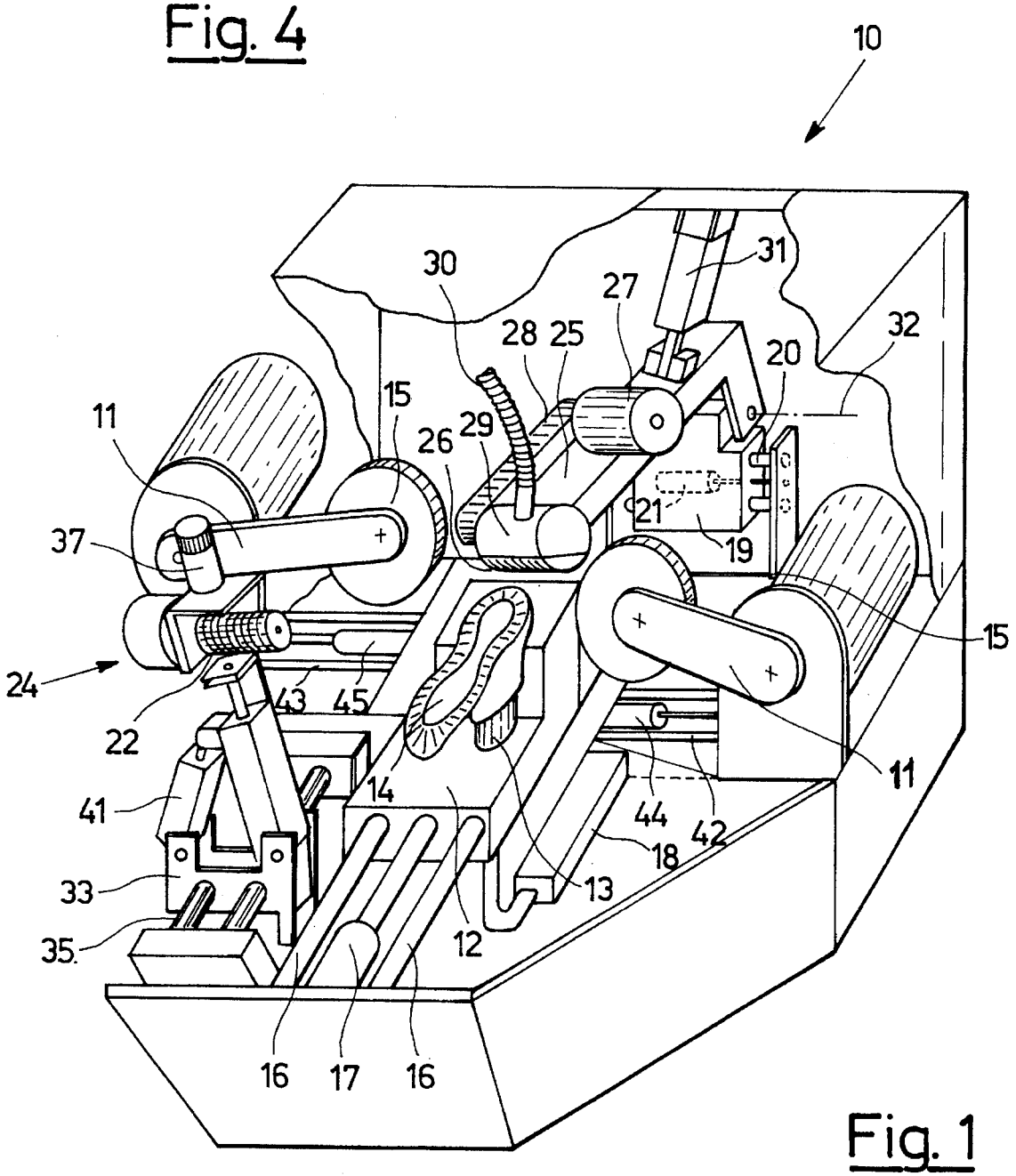
FIG. 1 shows a schematic front perspective view of a device according to the invention.

With reference to the figures, FIG. 1 schematically shows a device, generically indicated by reference 10, for machining the bottom of footwear 14 disposed on a support 13 protruding superiorly from a motorized saddle 12. The saddle 12 slides along guides 16 between a front position and a rear position by means of an actuator 17, for example a pneumatic or hydraulic cylinder. A position transducer 18 detects the position of the saddle along the guides.

The support 13 receives and supports the footwear 14 so that it is disposed with its bottom facing upwards and with its length parallel to the movement of the saddle so as to have its heel portion facing towards the rear position of the saddle.

Disposed on either side of the path of the saddle 12 are disk-shaped roughing wheels 15 which rotate in a vertical plane crosswise to the movement of the saddle 12. Each roughing wheel is supported by a respective arm 11 to enable it to move elastically in the vertical plane. The roughing wheels are also movable towards each other along guides 42, 43, crosswise to the path of the saddle 12, by means of respective actuators 44, 45. To prevent detachment of the upper during the operation, the roughing wheels are counter-rotating to provide a removing action towards the inside of the bottom of the footwear.

Figure 2:
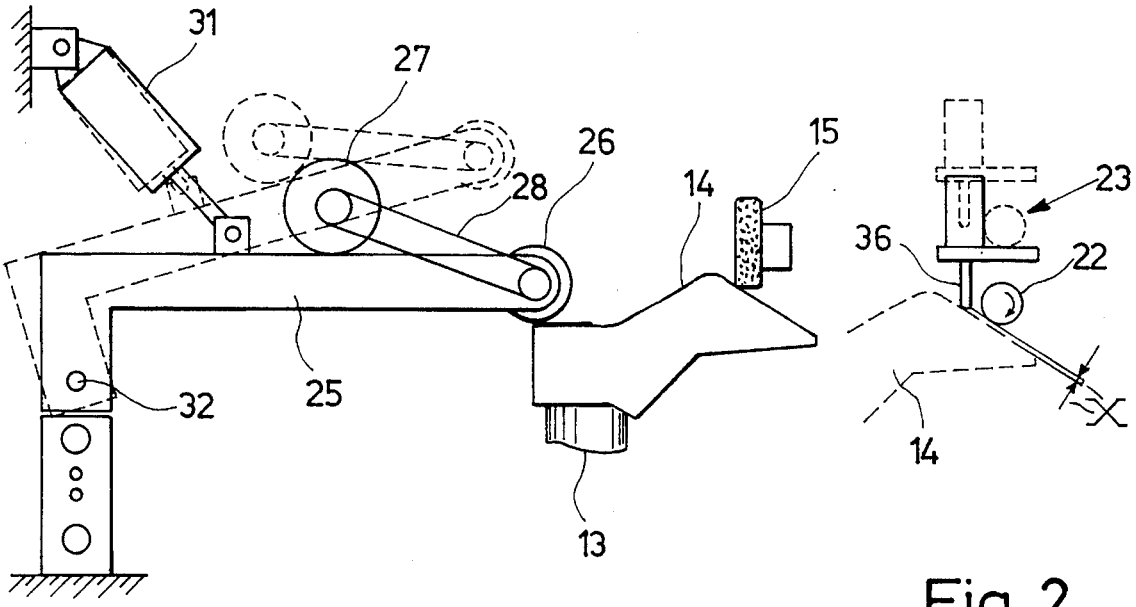
FIG. 2 shows a schematic lateral scrap view of the device of FIG. 1.

Close to the rear position of the saddle 12 is a first cylindrical rotating tool 26, disposed crosswise to the footwear and with its machining surface extending along the entire width of the footwear at least on its heel portion. The tool protrudes from a head supported so as to be elastically movable in a vertical direction, so as to be able to follow the outline of the bottom of the footwear, as will be clear further on, and rotates around its axis in an anticlockwise direction as can be seen in FIG. 2.

For example, the head of the tool 26 can be supported on the free end, or front end, of an arm 25, running parallel to the direction of movement of the saddle and pivoted at the other end, or rear end, according to a crosswise axis 32. The arm 25 also supports a motor 27 and actuator 28 for rotation of the tool.

The tool can be partially housed in a casing or guard 29 which, through a flexible duct 30, sucks up the material removed by the tool.

The arm 25 is supported by actuating mechanisms, represented by a pneumatic piston 31, so as to enable it to move from a raised or non-operative position (shown by the broken line in FIG. 2) to a lowered position (shown by the continuous line in FIG. 2) in which the tool rests on the bottom of the footwear fitted on the support 13. In the resting position, the piston 31 can also act as a pneumatic spring to maintain the pressure of the tool on the bottom of the footwear at a pre-established value. Stop devices limit the downward movement of the arm 25. Advantageously, the arm can be moved in a crosswise direction to the length of the footwear, so as to be able to adapt the crosswise position of the tool to different models of footwear and to right and left footwear. For this purpose, the pivoting axis 32 of the arm 25 is supported by a saddle 19 which slides parallel to said axis 32 by means of guides 20 and an actuator 21, for example a pneumatic or hydraulic cylinder.

To enable the free crosswise movement of the arm 25, the piston 31 can be connected between the arm and frame of the device by means of known articulated joints which permit the disalignment of the piston with respect to the plane of movement of the arm around the axis 32, or the piston 31 can be connected between the arm and the saddle 19 so as to move integrally with them, as can be easily imagined by the expert in the field.

Close to the front position of the saddle 12 is a second cylindrical rotating tool 22, disposed crosswise to the footwear and with its machining surface extending along the entire width of the footwear at least on its toe portion. The tool is supported so as to be elastically movable in a vertical direction, so as to be able to follow the outline of the bottom of the footwear, as will be clear further on, and rotates around its axis in a clockwise direction as can be seen in FIG. 2.

Figure 3:
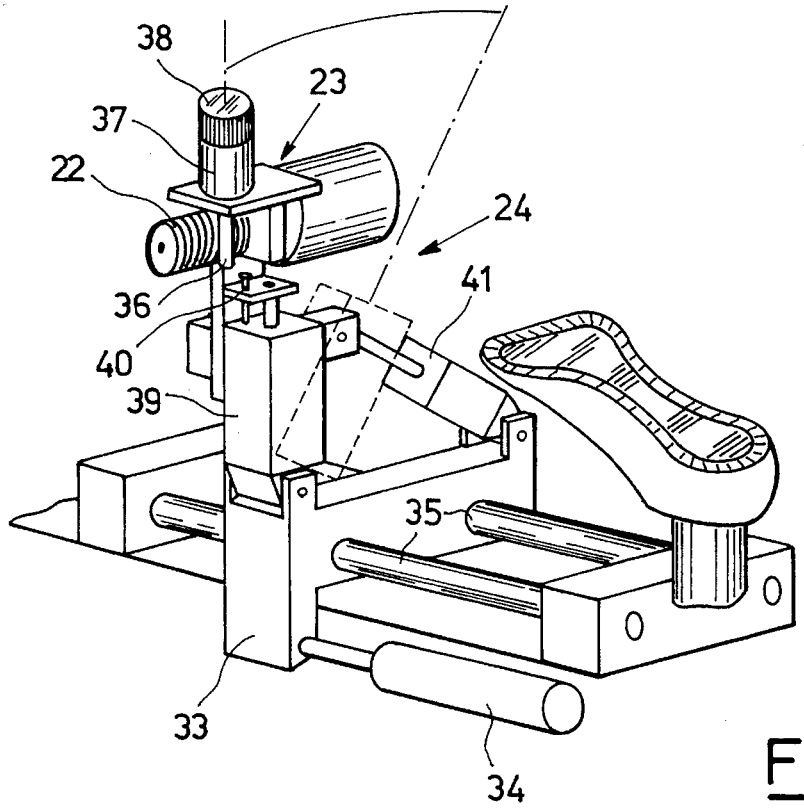
FIG. 3 shows a schematic rear perspective scrap view of part of the device of FIG. 1.

As can be seen more clearly in FIG. 3, the tool 22 can be made to protrude from a head 23 supported on top of a turret 24. The turret 24 is in turn supported by a saddle 33, made to slide by means of an actuator 34 along guides 35 which run parallel alongside the guides 16. In this way it is possible to adjust the distance between the rear tool 26 and front tool 22, so as to adapt the machine to work with footwear of different lengths.

The head 23 supports, on the side of the tool facing towards the footwear, an adjustable upright foot 36 to provide a lower resting surface as will be explained further on. The foot is movable vertically with respect to the tool by means of a motorized actuating device 37 with a position sensor or encoder 38.

The head 23 is movable vertically by means of an actuating device 39, advantageously achieved by means of a hydraulic piston, its minimum lower position being established by limit stop devices 40, for example achieved by means of a screw which can be screwed to varying degrees into the head 23 to protrude inferiorly towards a stop surface on the underlying part of the turret.

As can also be clearly seen in FIG. 3, the turret is also advantageously laterally inclinable by means of an actuating device 41 in order to shift from the operative position shown in FIG. 3, in which the centre line of the tool is aligned with the footwear, to a non-operative position (shown by the broken line) giving free access to the front part of the footwear for the operator.

When operating the machine, the saddle 12 is initially in its front position and the turret 24 is retracted to its non-operative position, so as to enable the operator to easily fit the footwear onto the support 13. On fitting the footwear onto the support 13, the machine is preset to work a right or left shoe by operating the actuator 21 which shifts the saddle 19 to the right or to the left by a pre-established distance for the particular model of footwear to be worked. Recognition of the right or left shoe can also be achieved automatically by means of a suitable sensor as is known in the field.

Depending upon the model and size of the shoe (measured automatically or set manually by the operator) the actuator 37 of the foot 36 is operated to shift the resting end of the foot to a position depending upon the inclination of the toe portion of the bottom of the footwear and on the thickness of the folded edge of upper that is to be left.

Upon detecting the size of the shoe, the position of the saddle 33 is varied so that the tool 22 comes to rest in the innermost position of the toe area to be machined. After the footwear has been fitted, the turret can shift to the operative position while the lifting piston 39 is operated to lay the tool 22 on the bottom of the footwear with the required pressure, the downward stroke of the head 23 being limited by the foot 36. After which, the actuator 17 is operated to push the saddle 12 towards its rear position, and begin the operation of rough scouring the toe.

As is shown schematically in FIG. 2, on encountering the bottom of the footwear the foot 36 keeps the front tool raised, so that the latter scrapes over the edge to be removed at the pre-established height. For example, FIG. 2 shows a foot adjustment which keeps the tool at a distance X from the bottom and consequently permits the removal of only the material of the upper protruding from the bottom by a distance greater than X. The effective height of the foot obviously depends upon the thickness of the upper and upon the inclination of the bottom to be machined, said inclination in turn depending upon the model of the footwear.

The weight of the head 23 determines the pressure of the tool on the bottom of the footwear. This weight can be partially counteracted by the piston 39 so as to regulate the bearing pressure of the tool.

Even though the front tool moves towards the outside of the bottom, its speed of rotation is sufficiently high compared to the speed of translation to ensure that the removing action is always directed towards the inside of the bottom, thereby preventing detachment of the edge of the upper.

When the footwear has reached the operating position of the roughing wheels, the lateral roughing wheels 15 are made to move towards each other, while the saddle 12 continues its movement, so as to remove material along the lateral edge of the upper folded over the bottom of the footwear.

When the footwear has moved back sufficiently to approach the operating area of the rear tool 26, the piston 31 is operated to shift the arm from its raised position to the position in which it rests the tool with a pre-established pressure on the heel area of the footwear, as shown in FIG. 2.

The saddle 12 continues its travel so that the tool 26 slides along the bottom of the footwear in the direction of the toe. The piston 31 exerts its pressure on the lever leaving it free however to follow the vertical outline of the bottom of the footwear. Advantageously, the footwear is fitted so as to have its heel area parallel to the direction of movement of the saddle.

The rough scouring is thus carried out, removing the part of the upper forming pleats raised from the bottom of the footwear in the heel area.

Figure 4:
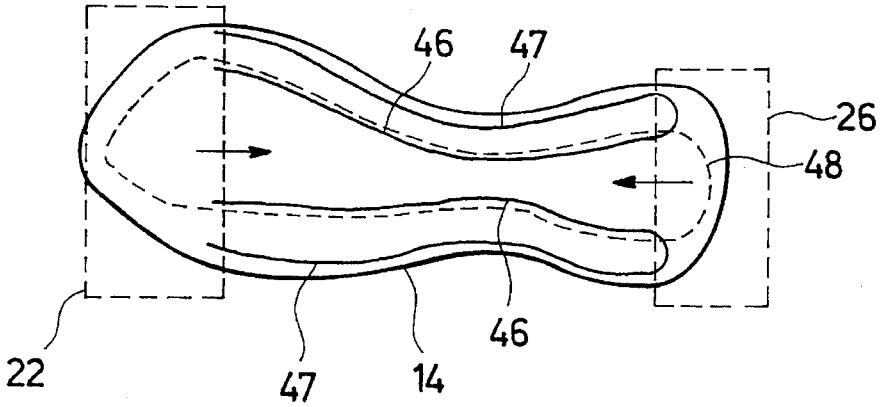
FIG. 4 shows a schematic diagram of the machining tools of the machine of FIG. 1 along the bottom of the footwear.

When the saddle 12 has moved backwards sufficiently to shift the tool to the end of the area to be worked with the tool 26 (for example before going on to the central area or waist of the shoe), the piston 31 raises the lever 25, while the saddle 12 continues its stroke until both the roughing wheels 15 have moved away from the toe of the shoe. At this point, the saddle 12 reverses direction and begins to move forward towards its initial front position. During this return movement, the lateral roughing wheels are shifted slightly by means of the actuating devices 44 and 45 so as to work a strip of the edge slightly offset with respect to the area of the edge worked during the forward movement of the saddle 12, so as to increase the width of the strip worked and the efficiency of the operation. FIG. 4 schematically shows a possible path followed by the roughing wheels. Advantageously, it has been found preferable to follow a more internal path, generically indicated by reference 46, during the forward movement, and a more external path, generically indicated by reference 47, during the return movement. The forward movement is also carried out in order to involve the hem 48 of the edge of the upper folded over the bottom of the footwear. In this way, the forward movement levels out the step formed on the bottom by the edge of the upper, while the return movement (if necessary, carried out with lighter pressure) roughs the upper to facilitate the subsequent attachment of the sole and smooths out any minor irregularities.

When the supporting saddle 12 has reached the foremost position, corresponding to the desired finishing of the bottom, the turret 24 can be returned to the reclined non-operative position and the operator can remove the shoe and send it on to the subsequent machining operations.

At this point it will be clear that the intended scopes have been achieved, by providing a structurally simple machine whereby it is possible to rough scour the bottom of the footwear quickly and efficiently, and simultaneously roughen the edge and if necessary smooth over any steps formed by the edge of the upper folded over the bottom.

With the machine according to the invention, the manufacturing times are optimized, the rough scouring of the toe area and roughing of the sides together with the final rough scouring of the heel area being carried out during the forward movement of the saddle 12, and the finishing "edge-wise" roughing being carried out during the return movement.

The foregoing description of an embodiment applying the innovative principles of this invention is obviously given by way of example in order to illustrate such innovative principles and should not therefore be understood as a limitation to the sphere of the invention claimed herein. For example, the exact proportions of the various parts of the machine described will depend upon particular practical and structural requirements.

The length of the area worked by the front and rear tools will depend upon the shape of the bottom. For example, in the case of women's high-heeled shoes, having a very narrow waist area, the rear tool will move forward along the waist to machine the lateral edges of the upper, since this area cannot be suitably worked by the lateral roughing wheels due to the extreme closeness of the left edge and right edge. In fact, their closeness would lead to the detachment of one edge under the action of the roughing wheel engaged in working the opposite edge.

Even though the front and rear tools are shown as cylinders, they can also have other forms of body of revolution. For example, they may have a slight concave or convex curve. As can be easily imaged by the expert in the field, the tools and roughing wheels can be made in the form of metal brushes or bodies of revolution with their outer surfaces covered with abrasive substances with a particle size suitable for the type of upper to be removed and for manufacturing requirements.

Lastly, the use of a rear tool with a simple pivoted lifting arm and a front tool with a vertical movement and resting foot has proved to be ideal in achieving a satisfactory ratio between inexpensiveness of the machine and performance. In fact, the rear portion of the bottom is generally flat while the front portion is more shaped.

However, as can be easily imagined by the expert in the field, it is possible to equip the rear hinged-arm tool with a foot resting on the bottom of the footwear or replace said tool with a tool assembly similar to the front one. Likewise, the front tool can be made with an arm movement similar to the rear one, if necessary maintaining shifting means to enable easy introduction and removal of the footwear.

What is claimed is:

1. Device for removing material from a portion of an edge of an upper folded over a bottom of footwear, the bottom being elongate and extending in a length direction between a front toe area and a rear heel area with longitudinally extending, lateral edges bounding inside and central areas, the device comprising:

a support for the footwear having a front and a rear and opposite lateral sides for supporting the footwear extending longitudinally thereof, along a front to rear axis;

means for mounting roughing wheels at respective lateral sides of and posteriorly and anteriorly to the support, respectively, with respective axes of rotation substantially parallel to the front to rear axis so as to be substantially parallel to a length direction of the footwear when supported by the support;

means for mounting further rear and front working tools for rotation in respective opposite rotational directions about respective axes extending substantially perpendicular to the front to rear axis so as to be substantially perpendicular to the length direction of the footwear and substantially parallel to the bottom;

means mounting the support for movement in the direction of the front to rear axis corresponding to the length direction of the footwear supported by the support in relation to the roughing wheels and front and rear tools thereby to shift the lateral edges of the bottom of supported footwear longitudinally into working areas of the roughing wheels and to shift the respective toe and heel areas of the bottom of the supported footwear into working areas of the front tool and the rear tool with a working action toward the inside area of the bottom.

2. Device as claimed in claim 1, characterized by the fact that the roughing wheels are movable crosswise to the front to rear axis corresponding to the length direction of the footwear thereby to vary their working areas along the edges of the bottom.

3. Device as claimed in claim 1, characterized by the fact that the support mounting means mounts the support for movement substantially parallel to the front to rear axis corresponding to the length direction of the footwear to carry out a forward movement towards a rear position and a return movement towards a front position, between the forward movement and the return movement, the mounting means for the roughing wheels moving the roughing wheels crosswise to involve lateral areas of the edges at different distances towards the inside area of the bottom.

4. Device as claimed in claim 3, characterized by the fact that during the forward movement, the mounting means for the roughing wheels moves the roughing wheels to work lateral areas of the edges which are closer to the inner area than lateral areas that are worked by the roughing wheels during the return movement.

5. Device as claimed in claim 3, characterized by the fact that the front tool mounting means brings the front tool into contact with the respective toe area of the bottom of the footwear upon the forward movement of the support towards the rear position.

6. Device as claimed in claim 1, characterized by the fact that the tools have means for moving them from a first position raised from the bottom of the footwear to a second position with their working surface resting on said bottom in the respective area.

7. Device as claimed in claim 3, characterized by the fact that the rear tool mounting means brings the rear tool into contact with the respective heel area of the bottom of the footwear upon the forward movement of the support towards the rear position.

8. Device as claimed in claim 1 characterized by the fact that the rear tool mounting means includes an arm directed substantially parallel to the front to rear axis corresponding to the length direction of footwear, the arm having one free end supporting the rear tool and a second end hinged for movement about an axis transverse to the front to rear axis by first moving means, from a raised position of non-interference with the bottom of the footwear to a lowered position in which the rear tool rests and works on the bottom of the footwear.

9. Device as claimed in claim 8, characterized by the fact that the hinging of the second end is supported by a saddle which is movable by means of second moving means between two extreme positions in a direction parallel to the hinging axis.

10. Device as claimed in claim 8, characterized by the fact that the first moving means comprise springs to push the tool towards the bottom of the footwear with a pre-established pressure when the arm is in said lowered position.

11. Device as claimed in claim 10, characterized by the fact that the springs comprise a pneumatic cylinder.

12. Device as claimed in claim 1, characterized by the fact that the front tool is supported by a head movable from a raised position to a position in which the tool rests on the bottom, the head comprising a foot protruding from it towards the bottom of the footwear to define a surface which rests on said bottom in a direction of movement of the tool towards the surface to be worked.

13. Device as claimed in claim 12, characterized by the fact that the protruding foot comprises adjusting means for adjusting the position of the resting surface in the direction of movement of the tool, in order to regulate the degree to which the tool penetrates into the bottom.

14. Device as claimed in claim 12, characterized by the fact that the turret has a linear movement actuator to vertically achieve the movement between the raised position and resting position of the tool on the bottom.

15. Device as claimed in claim 14, characterized by the fact that the linear actuator is a hydraulic piston.

16. Device as claimed in claim 15, characterized by the fact that the piston is arranged to provide an upward thrust close to the resting position which thrust partially counteracts weight of the tool supporting head pushing the tool towards the resting position.

17. Device as claimed in claim 15, characterized by the fact that the roughing wheels are supported by arms pivoted to move elastically in a plane substantially perpendicular to the front to rear axis corresponding to a longitudinal axis of the footwear.

18. Device as claimed in claim 12, characterized by the fact that the foot is disposed on one side of the tool facing towards the central area of the bottom.

19. Device as claimed in claim 1, characterized by the fact that means are provided for moving the front and rear tools relatively thereby to adjust the separation thereof in the direction of the front to rear axis corresponding to the length direction of the footwear.

20. Device as claimed in claim 19, characterized by the fact that the means for moving the front and rear tools to adjust the separation thereof includes motorized saddle supporting the front tool mounted for movement substantially parallel to the front to rear axis corresponding to the length direction of the footwear.

21. Device as claimed in claim 1, characterized by the fact that the front tool is supported by moving means for moving the front tool between a first operative position in which it has its axial center line substantially aligned with the front to rear axis corresponding to a longitudinal axis of the footwear and a second, lateral, non-operative position spaced from said first position.

22. Device as claimed in claim 21, characterized by the fact that the moving means comprise a turret with a head supporting the tool, the turret being hinged close to its base so as to be laterally inclined by means of an actuator between said first operative position and said second distant position.

23. A device as claimed in claim 22, characterized by the fact that the turret has a linear movement actuator for providing the vertical movement between the raised position and the resting position of the tool on the bottom.

24. A device as claimed in claim 23, characterized by the fact that the linear actuator is a hydraulic piston.

25. A device as claimed in claim 24, characterized by the fact that, the piston is arranged to provide an upward thrust close to the resting position which thrust partially counteracts weight of the tool supporting head pushing the tool towards the resting position.

* * * * *